United States Patent [19]

Delepine

[11] Patent Number: 5,060,322

[45] Date of Patent: Oct. 29, 1991

[54] SHOWER ROOM AND CEILING ELEMENT, ESPECIALLY FOR A SHOWER ROOM

[76] Inventor: Jean-Claude Delepine, 23 rue Clapeyron, 75008 Paris, France

[21] Appl. No.: 384,287

[22] Filed: Jul. 27, 1989

[51] Int. Cl.[5] ..... A47K 3/22

[52] U.S. Cl. ..... 4/601; 4/612

[58] Field of Search ..... 4/596, 605, 612, 613, 4/614, 615, 597, 601, 602, 525, 603, 617

[56] References Cited

U.S. PATENT DOCUMENTS

| | | | |
|---|---|---|---|
| 870,766 | 11/1907 | Eaton | 4/601 X |
| 1,556,765 | 10/1925 | Dechmann | 4/615 X |
| 3,007,178 | 11/1961 | Altman et al. | 4/525 |
| 3,852,834 | 12/1974 | Morris | 4/612 X |
| 3,984,879 | 10/1976 | Ejchorszt | 4/601 |
| 4,122,558 | 10/1978 | DiLiberto et al. | 4/612 |
| 4,348,777 | 9/1982 | Paterson | 4/597 X |
| 4,724,553 | 2/1988 | Bianchi | 4/615 |
| 4,809,369 | 3/1989 | Bowden | 4/596 X |

FOREIGN PATENT DOCUMENTS

| | | | |
|---|---|---|---|
| 5012 | of 1887 | United Kingdom | 4/612 |
| 355758 | 2/1930 | United Kingdom . | |

*Primary Examiner*—Henry J. Recla
*Assistant Examiner*—Robert M. Fetsuga
*Attorney, Agent, or Firm*—Marshall, O'Toole, Gerstein, Murray & Bicknell

[57] ABSTRACT

A ceiling shower element for a shower room comprises a plate adapted to be installed in the ceiling of the shower room, and an inverted concave housing having its edges sealed to said plate and defining therewith a hollow cavity to which water is supplied. The portion of the plate which seals off the housing is provided with orifices through which water is ejected into the room below.

11 Claims, 4 Drawing Sheets

44
41
43
51
42
51
7
8
9
47
49
46
50
45
48
40

SHOWER ROOM AND CEILING ELEMENT, ESPECIALLY FOR A SHOWER ROOM

FIELD OF THE INVENTION

The present invention concerns a shower room.

BACKGROUND OF THE INVENTION

A shower room generally comprises, for example, a shower booth, possibly encompassed by protective side walls, and a pipe, one of whose extremities is connected to a water inlet pipe, the other extremity being fitted with a shower rose, which enables water to be projected in the form of a multitude of pressurized fine sprays through the holes provided in said shower rose.

Despite the widespread usage of these shower rooms, the design of said rooms nevertheless presents a certain number of drawbacks.

In fact, although a search is currently under way to find means to embed the cocks of feed taps inside the walls for reasons of safety and aesthetics, the unit formed by the pipe and the shower rose is nearly always disposed in such a way that is projects with respect to the wall on which said unit is secured, this providing to be particularly unaesthetic and presenting a safety risk for the user.

SUMMARY OF THE INVENTION

The object of the this invention is to overcome these drawbacks by providing a shower room whose design allies both safety and aesthetics.

To this effect, the shower room of the type comprising in particular at least one water inlet pipe and water feed control devices is, according to the invention, notable in that it comprises at least one ceiling element in which there is provided at least one closed cavity able to be connected to said water inlet pipe, the lower face delimiting said cavity having a plurality of orifices intended to eject water passing through said cavity.

Thus, by means of the present invention, the shower room dispenses with elements usually projecting from the walls of said room, since the water inlet pipe no longer projecting from said cabin can directly reach the ceiling element by being connected to the closed cavity provided inside the latter, said cavity then acting as a shower rose.

The present invention also concerns a ceiling element, in particular for a shower room, whose design enables the room to dispense with elements usually fitted projecting with respect to its walls.

To this effect, the ceiling element, in particular intended for a shower room, is notable in that, according to the invention, it comprises at least one closed cavity able to be connected to a water inlet pipe, the interior surface, delimitating said cavity, exhibiting a plurality of orifices intended to eject water in transit in said cavity.

Thus, by means of the ceiling element having a closed cavity connected to the water inlet pipe, the walls of said room no longer have, for example, the unit made up of the pipe and shower rose usually provided.

According to another characteristic of the invention, said ceiling element can be constituted by a plate and a mounted open housing having its edges sealed to said plate, said cavity corresponding to the internal volume delimited by said housing and plate.

In a preferred form of embodiment, said open housing is mounted on top of the plate, the bottom of said housing corresponding to the upper face of said cavity being provided with a joining piece intended for connection of the water inlet pipe, whereas the part of the plate delimiting the lower face of said cavity is provided with said water ejection orifices.

Advantageously, said cavity is symmetrically embodied with respect to the axis orthogonal to the plane of said element and traversing its centre.

In a first embodiment variant, the lower face of the cavity fitted with said ejection water orifices may have a circular shape.

However, in a second embodiment variant, the lower face of the cavity fitted with said water ejection orifices may have a polygonal shape.

Advantageously, for reasons of aesthetics, the part of the plate, corresponding to the lower face of the cavity and provided with said water ejection orifices, projects from said plate. Moreover, said water ejection orifices may respectively comprise ejection nozzles, said orifices being moreover regularly distributed over said lower face of the cavity.

According to another characteristic, said element may comprise at least one opening, external to said cavity and sealed off by a cover made of a translucent material, low-voltage lighting means being fixed to said element so as to diffuse light towards said room through said cover.

Advantageously, said opening has the shape of a crown concentric with said cavity. In another form of embodiment, said opening may have a polygonal shape concentric with said cavity.

Thus, when said opening, whose shape preferably corresponds to that of the external face of said cavity is lit by the lighting means and when a multitude of fine pressurized squirts of water issue from said orifices, a genuine aesthetic effect is obtained.

The invention also concerns a shower room of the type comprising at least one ceiling element, as described previously, and is notable in that it comprises a plurality of water inlet pipes, one of which is connected to said cavity, the others being able to be connected, preferably from the side higher than said element, to equipment provided in said room, said equipment being, for example, a spraying ramp, a shower pipe-rose unit and the like, through passage provided in said ceiling element.

Thus, a shower room already comprising, for example, a spraying ramp and a unit, usually constituted by a pipe completed by a shower rose, can advantageously, be fitted with a ceiling element according to the invention without any additional work being required, since said ramp and said unit can be directly connected through passages provides in the ceiling element to the corresponding water inlet pipes.

Conversely, these water inlet pipes may possibly be eventually used for installing, for example, a spraying ramp.

BRIEF DESCRIPTION OF THE DRAWINGS

The figures of the attached drawing clearly explain how the invention can be embodied. These figures contain identical references denoting similar elements.

DETAILED DESCRIPTION OF THE PREFERRED EMBODIMENTS

Figure 1:
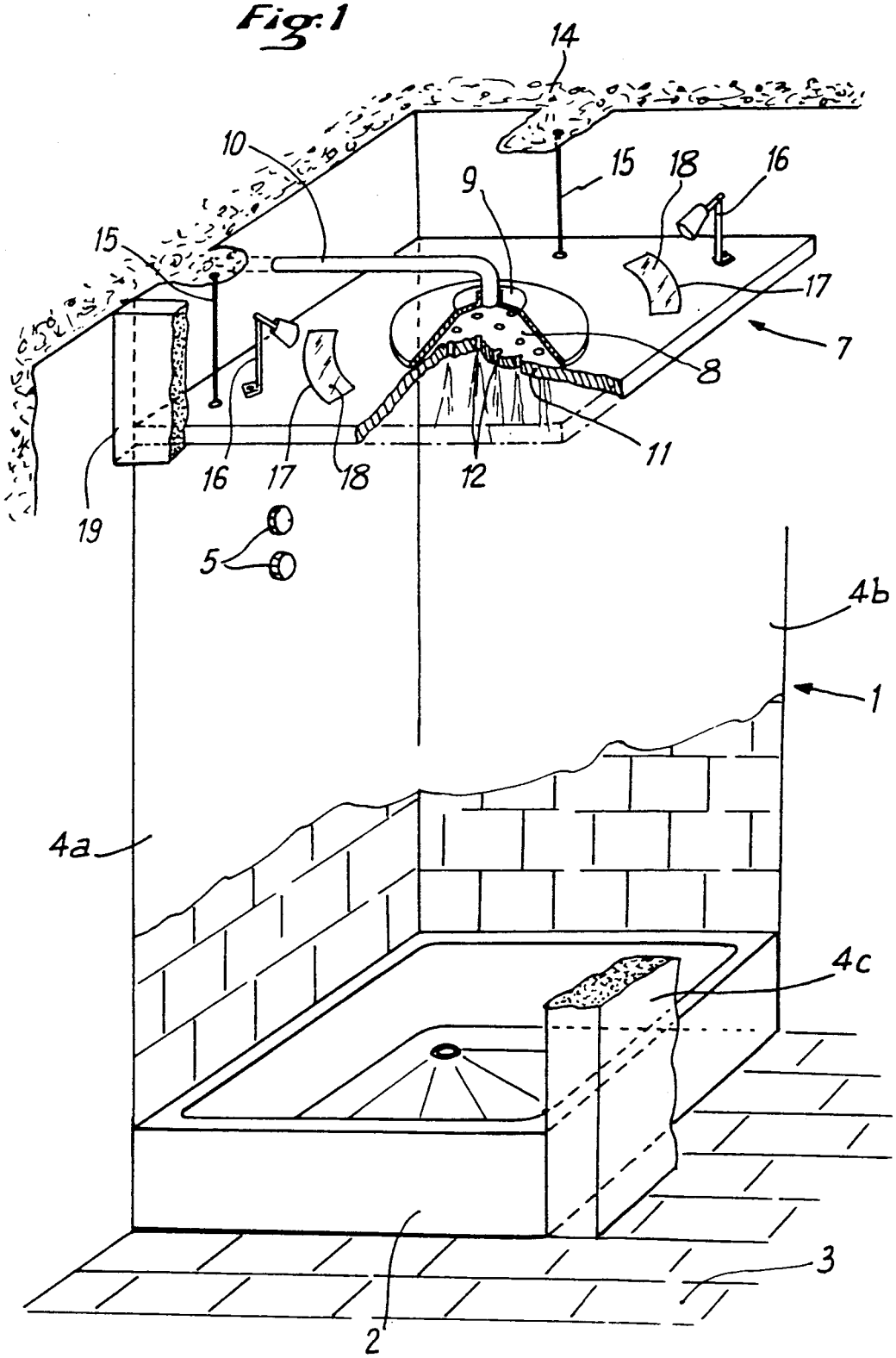
FIG. 1 is a partially exploded perspective view of a shower room according to the invention.

With reference to FIG. 1, the shower room 1 comprises, for example, a shower container 2 resting on a tiled floor 3 and, in this case, disposed between the walls 4*a*, 4*b*, 4*c* perpendicular to each other, the wall 4*c*, parallel to the wall 4*a*, being partially shown in the figure. Devices 5 for controlling the supply of hot and cold water are fitted on the wall 4*a* and may be taps whose valve bodies are advantageously embedded inside the wall for safety and aesthetic reasons. These devices or taps 5 are connected to a mixing tap (not shown).

According to the invention, the shower room 1 comprises a ceiling element 7 in which is provided at least one closed cavity 8 able to be connected via its upper face 9 delimiting it to a water inlet pipe 10 coming from the mixing tap and coming out of the wall 4*a* above said ceiling element 7. The lower face 11, which delimits the cavity 8 and which is consequently turned opposite the shower container 2, has a plurality of orifices, evenly distributed and designed to eject water in transit in the cavity 8 and arriving via the pipe 10, when the taps 5 are turned on. Preferably, the closed cavity 8 is provided in the centre of the ceiling element 7, the latter being able to be embodied in a synthetic material and obtained, for example, by molding.

As shown on FIG. 1, the ceiling element 7 is suspended from the ceiling 14 of the room 1 by means of rods 15 diagramatically represented, but it could be fixed by angle brackets to the walls 4*a*, 4*b*, 4*c* or even be laid on strips fixed to the walls. Thus, in the illustrated mode of embodiment, the ceiling element, 7 acts as a false ceiling. However, it goes without saying that it could correspond to the ceiling itself in which a closed cavity has been provided.

As can be seen on FIG. 1, the walls 4*a*, 4*b* and 4*c*, according to the invention, are free from elements usually projecting from said walls, such as the unit constituted by a flexible or rigid pipe to which a shower rose is connected, since the water inlet pipe 10 comes out of the wall 4*a* above said ceiling element 7 (if the thickness of the latter so allows, the water inlet pipe 10 could be embedded inside the element so as to come out in the closed cavity 8), whereas the closed cavity 8 acts as a shower rose. The absence of elements usually disposed projecting from the walls of the shower room this increases safety and renders said room more aesthetic.

Moreover, this figure shows that the low-voltage lighting means 16 are fixed to the ceiling element 7 on its upper face. Openings 17 are then provided in the ceiling element 7, said openings being sealed off by covers, preferably made of a translucent material. This disposition thus makes it possible to diffuse the light derived from the lighting means 16 into the shower room through the translucent covers 18, which provides a genuine aesthetic effect when the water, derived from the inlet pipe 10 and in transit in the cavity, is projected in the form of a plurality of fine pressurized squirts through the orifices.

In the illustrated mode of embodiment, a front panel 19 seals off the space delimited between the ceiling element 7 and the ceiling 14.

Figure 2:
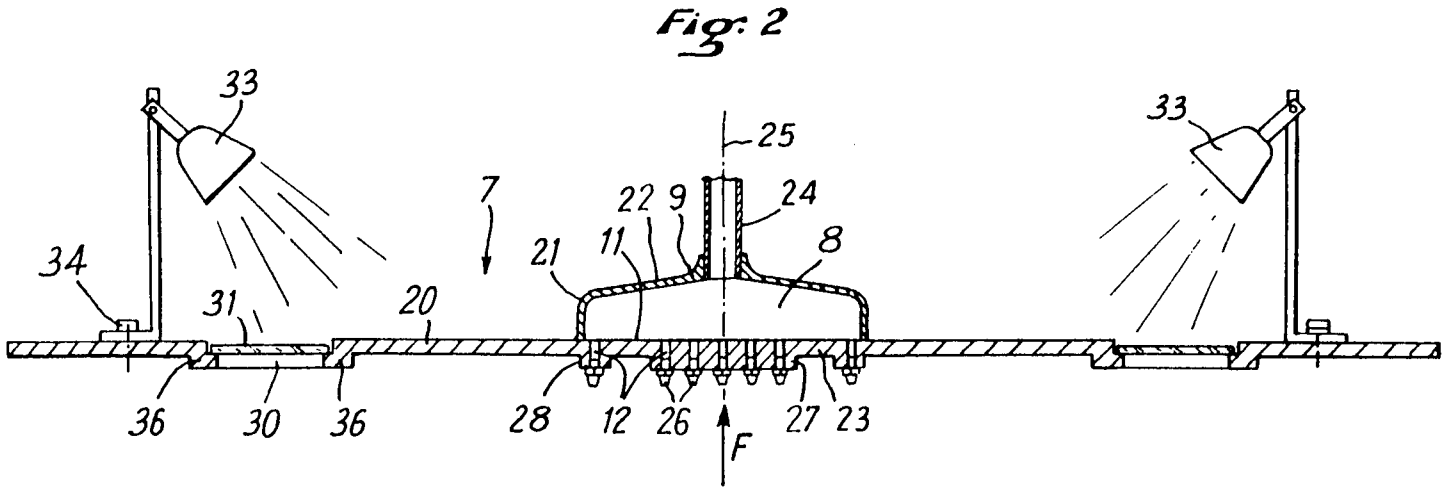
FIG. 2 shows a cutaway view of a ceiling element according to the invention.

The ceiling element 7 shown in a cutaway view on FIG. 2 is especially intended for a shower room. This element 7 comprises at least one closed cavity able to be connected to a water inlet pipe, (not shown on this figure) the lower face 11, which delimits said cavity 8, having a plurality of orifices 12 intended to eject the water in transit in the cavity and arriving via the water feed pipe.

Figure 3:
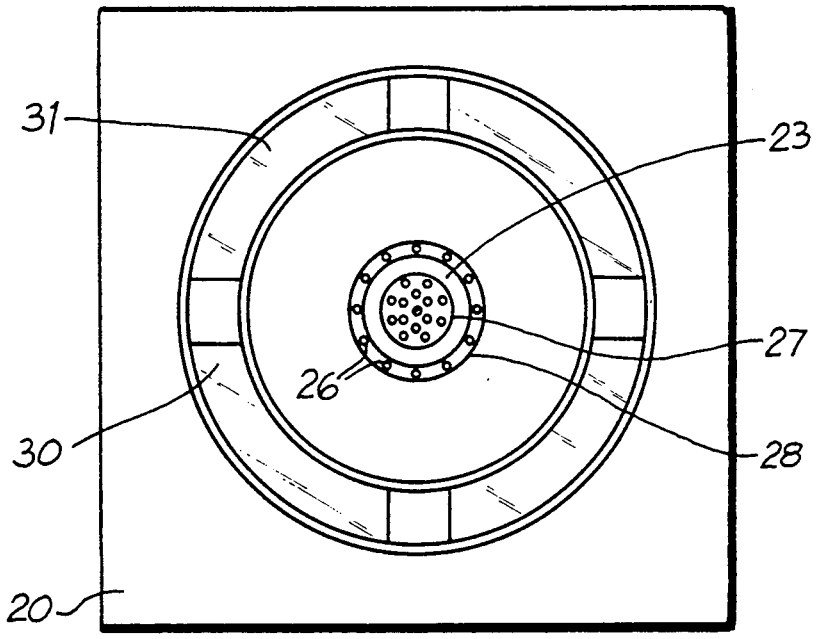
FIG. 3 is a reduced-scale bottom view of said ceiling element along the arrow F of FIG. 2.

In the particular mode of embodiment illustrated opposite FIGS. 1 and 3, said ceiling element 7 is constituted by a plate 20 and a mounted open housing 21 sealed to the plate, the closed cavity 8 corresponding to the internal volume delimited by the plate 20 and the housing 21. Preferably, the open housing 21 is mounted on top of the plate so that the bottom 22 of the housing corresponds to the upper face 9 of the cavity 8, whereas the lower face 11 of the cavity 8 corresponds to the part 23 of the plate 20, delimited by the housing 21.

Thus, the upper face 9 of the cavity 8, corresponding to the bottom 22 of the housing 21, comprises a joining piece 24 intended to receive the extremity of the water inlet pipe (not shown), whereas the lower face 11 of the cavity, corresponding to the part 23 of the plate 20, is provided with a plurality of orifices 12.

The cavity 8 is centered symmetrically with respect to the axis 25 orthogonal to the plane (horizontal plane on the figure) of the ceiling element 7 and passing through its centre. A seal between the housing 21 and the plate 20 is obtained, for example, by means of a suitable adhesive product.

The ceiling element could possibly be embodied by moulding.

As shown on FIG. 3, the plate 20 of the ceiling element 7 has an approximately square shape, but other shapes are possible according more particularly to the shape of the shower room.

The orifices 12 are provided with ejection nozzles 26 allowing for a fine pressurized projection of the water and are regularly distributed over the lower face 11 of the cavity 8 corresponding to the part 23 of the plate 20.

To provide aesthetics, this part 23 or lower face 11 is advantageously arranged to be projecting with respect to the plane of the plate 20.

In the embodiment shown on FIGS. 2 and 3, the orifices 12 mounted on the nozzles are provided firstly on a central disk 27 with respect to the axis 25, said disk projecting from the plane of the plate, and secondly on a crown 28 concentric to the disk 27 and also projecting from the plane of the plate. Thus, a regular well-balanced disposition of the ejection orifices 12 is obtained, as shown on FIG. 3.

In addition, a circular opening 30 is also provided in the plate 20, said opening being concentric with the cavity and sealed off by a cover 31 with a corresponding shape and advantageously made of a translucent material, such as obscured glass. Lighting means 33, of the low-voltage type shown on FIG. 2, are then fixed by screws or similar devices 34 to the plate 20 so as to diffuse the light towards said room through the translucid cover 31. These lighting means 33 are, for example, low-voltage spotlights and may either be two in number, which are then disposed diametrically to each other, or may be four in number, which are then disposed close to each corner of the plate 20.

So as to match the aesthetics of the ceiling element, the external and internal circular edges 36 of the opening 30 project from the plane of the plate 20 in the same way as the disk 27 and crown 28 equipped with the ejection nozzles. In this case, the translucent cover 31 rests on the edges 36, as shown on FIG. 2.

Thus, a ceiling element is obtained whose face turned towards the room is attractive and aesthetic.

Figure 4:
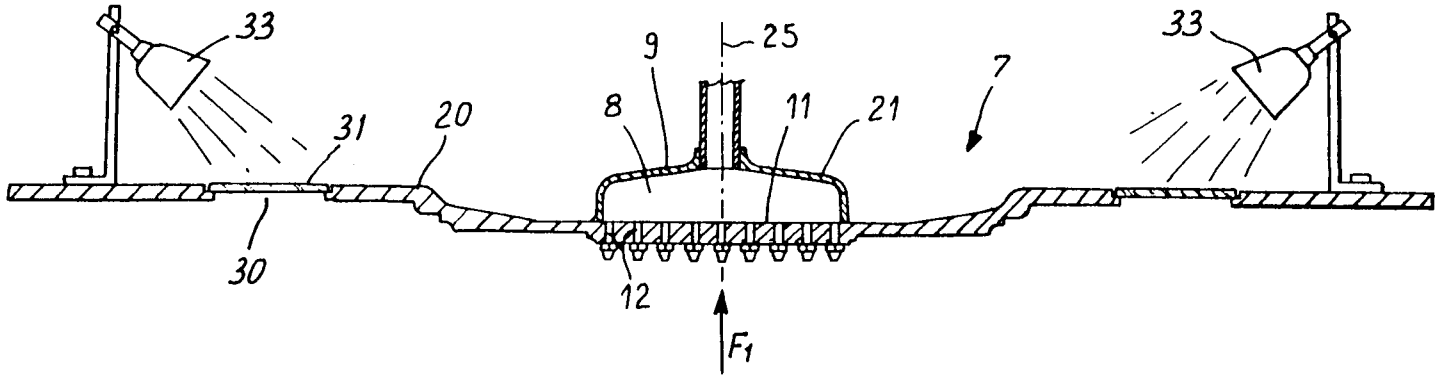
FIG. 4 shows a cutaway view of an embodiment variant of said ceiling element.
Figure 5:
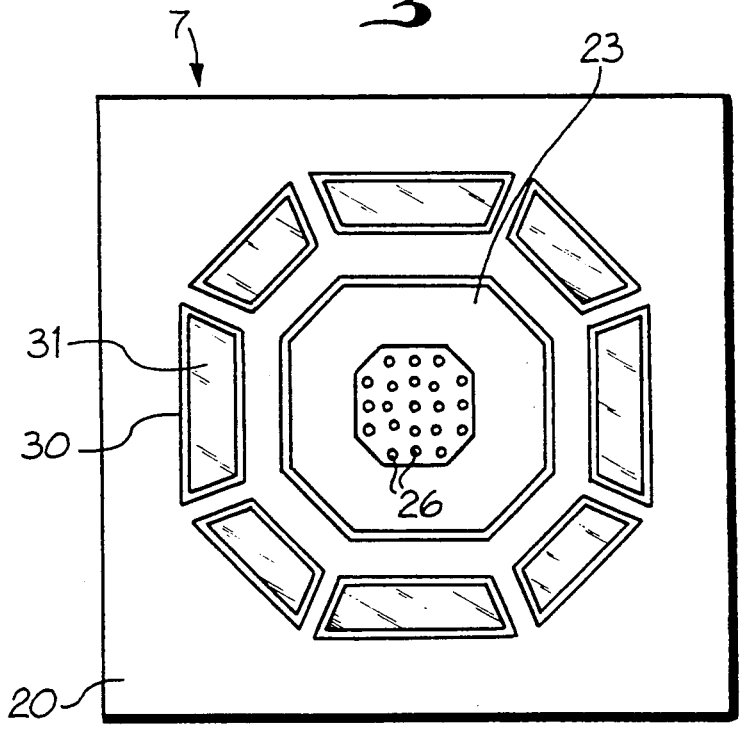
FIG. 5 shows a reduced-scale bottom view of said ceiling element along the arrow F1 of FIG. 4.

As regards FIGS. 4 and 5, these represent an embodiment variant of the ceiling element 7 which is mainly characterized in that the lower face 11 of the cavity corresponding to the part 23 of the plate 7 has a polygonal shape, such as an octagonal shape.

The orifices 12 are than distributed around circles concentric with the orthogonal axis (FIG. 5). In order to preserve harmony of the octogonal face projecting from the plane of the plate, the openings 30 are disposed in the same way, as shown on FIG. 5.

Quite clearly, it is possible to envisage various shapes for the openings 30 and the part 23 of the plate 20 or even different combinations of shapes of these, for example, a polygonal part 23 and a circular opening, without departing from the context of the invention.

Figure 6:
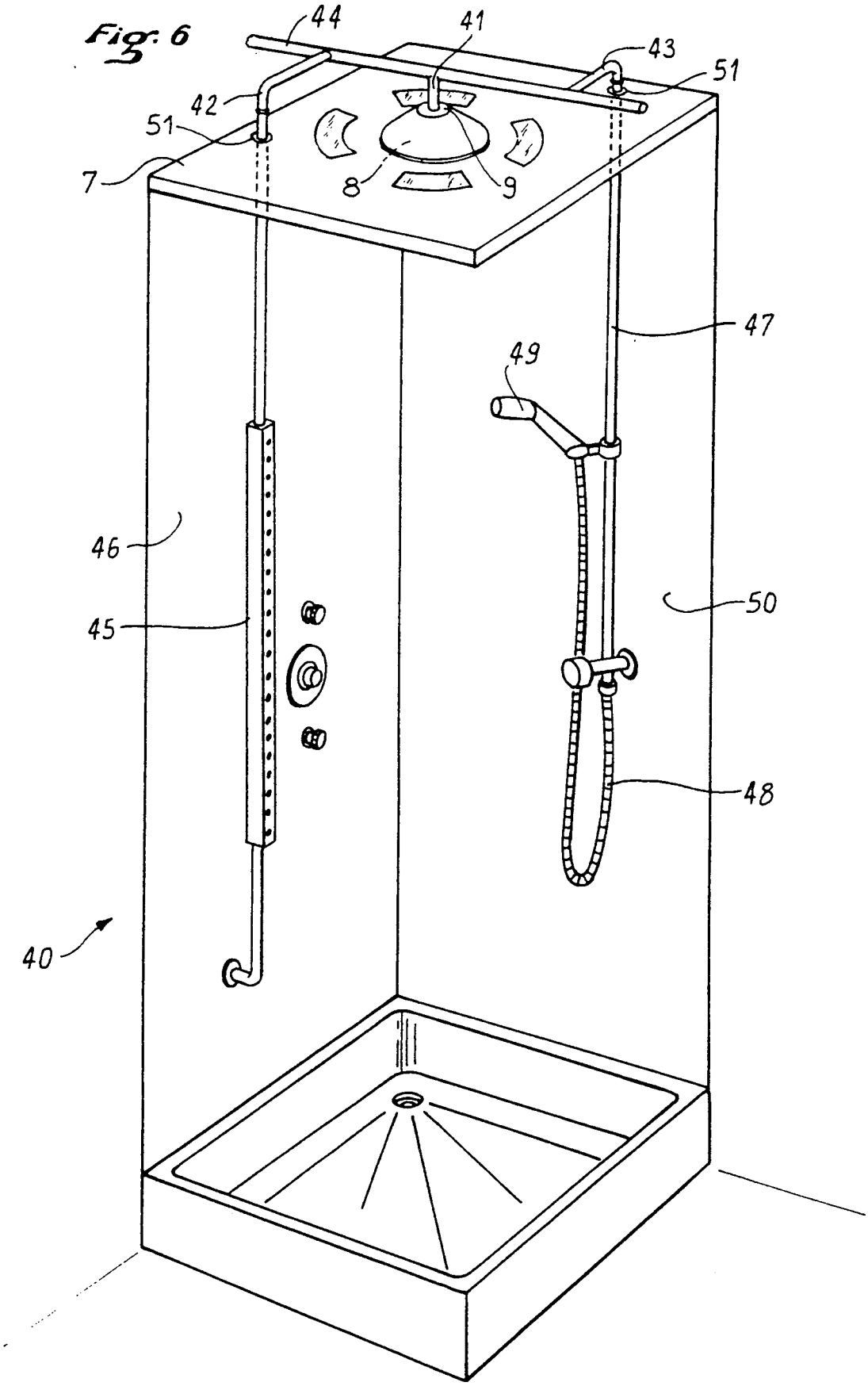
FIG. 6 diagramatically shows a perspective view of a shower room comprising a ceiling element according to the invention, as well as annexed equipment.

The shower room illustrated on FIG. 6 is equipped with a ceiling element 7, as described above, but whose lighting means have not been represented. Without reconsidering the structure of the ceiling element 7, it can be seen that the room 40 is provided with a plurality of inlet pipes 41, 42 and 43 derived from, for example, a conduit 44 connected to a mixing tap (not shown). FIG. 6 shows the pipe 41 connected to the upper face 9 delimiting the cavity 8, whilst the pipe 42 is firstly connected to a spraying ramp 45 fixed to one of the walls 46 of said room, and secondly the pipe 43 is connected to a tube 47 on the extremity of which a flexible joint is mounted bearing a shower rose 49, the tube 47 being fixed to a wall 50 of said room. Passages 51 are obviously provided in the plate 7 of the ceiling element so as to allow for mounting of its annexed equipment, or conversely, for a ceiling element to be adapted to a shower room already provided with such equipment.

Thus, by virtue of this conduit with several connection pipes or by means of several conduits it is easily possible, without involving complicated work operations, to carry out, for example, connections of annexed equipment.

What is claimed is:

1. A ceiling element for a shower room of the type having rearwall and sidewalls defined as part of a room enclosure, said element comprising a substantially planar plate having at least one closed cavity therein adapted to be connected to a water intake pipe, said plate being sized and adapted to be mounted to said rear and side walls as a ceiling of said shower room, said cavity being comprised of said substantially planar plate defining a lower face of said cavity and a hollow housing sealed to said plate, the portion of said plate corresponding to said cavity being provided with a plurality of orifices adapted to eject water entering said cavity.

2. A ceiling element according to claim 1, wherein said housing is above said plate and being provided with a joining piece adapted for the connection of said water intake pipe.

3. A ceiling element according to claim 1, wherein said closed cavity is positioned symmetrically with respect to an axis orthogonal to the plane of said plate and passing through the middle of said housing.

4. A ceiling element according to claim 1, wherein said lower face has a circular shape.

5. A ceiling element according to claim 1, wherein said lower face has a polygonal shape.

6. A ceiling element according to claim 1, wherein a portion of said plate corresponding to the lower face of said cavity projects from the remainder of said plate.

7. A ceiling element according to claim 1, wherein said water ejection orifices comprise ejection nozzles, said orifices being regularly distributed over said lower face.

8. A ceiling element according to claim 1, further comprising at least one opening in said plate outside said cavity, said opening being sealed by a cover comprising a translucent material, and low-voltage lighting means directing light toward said translucent material whereby light diffuses therethrough into said room.

9. A ceiling element according to claim 8, when said opening has the shape of a crown concentric with said cavity.

10. A ceiling element according to claim 8, wherein said opening has a polygonal shape concentric with said cavity.

11. A shower room comprising at least one ceiling element in accordance with claim 1, and said plate further including a plurality of water intake pipe passages outside of said cavity for the passage of pipes adapted to be connected to items of equipment selected from a spraying ramp and a shower rose-pipe unit inside of said shower room.

* * * * *